US006531914B2

(12) United States Patent
Kawakubo

(10) Patent No.: US 6,531,914 B2
(45) Date of Patent: Mar. 11, 2003

(54) INTERNAL VOLTAGE GENERATION CIRCUIT

(75) Inventor: Tomohiro Kawakubo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/776,889

(22) Filed: Feb. 6, 2001

(65) Prior Publication Data

US 2001/0017567 A1 Aug. 30, 2001

(30) Foreign Application Priority Data

Feb. 28, 2000 (JP) ..... 2000-051336

(51) Int. Cl.[7] ..... G05F 1/10; G05F 3/02
(52) U.S. Cl. ..... 327/541; 323/315
(58) Field of Search ..... 327/538, 540, 327/541, 543, 77, 78, 80; 323/315, 274, 281

(56) References Cited

U.S. PATENT DOCUMENTS 5,696,440 A * 12/1997 Harada ..... 323/313
5,929,696 A * 7/1999 Lim et al. ..... 327/540
5,942,809 A * 8/1999 Hashimoto ..... 307/43
6,078,210 A * 6/2000 Uchida et al. ..... 327/530
6,137,348 A * 10/2000 Uchida et al. ..... 327/541
2001/0011886 A1 * 8/2001 Kobayashi ..... 323/281

* cited by examiner

*Primary Examiner*—Terry D. Cunningham
*Assistant Examiner*—Quan Tra
(74) *Attorney, Agent, or Firm*—Arent Fox Kintner Plotkin Kahn, PLLC

(57) ABSTRACT

An internal voltage generation circuit with a small area, which has many correction points and can provide an output voltage with a high precision, has been disclosed. In this internal voltage generation circuit, some resistors, among the resistors which are connected in series constituting the feedback circuit, have different resistance and transfer gates are provided in parallel to the resistors of different resistance. This configuration has a decode function and, therefore, the decoder can be eliminated and the number of sets of an inverter, a transfer gate, and a resistor can also be reduced, resulting in a reduction in area without a reduction in the number of the correction points.

3 Claims, 5 Drawing Sheets

INTERNAL VOLTAGE GENERATION CIRCUIT

BACKGROUND OF THE INVENTION

The present invention relates to an internal voltage generation circuit which is provided in a semiconductor device and generates an internal power source of a predetermined voltage from an external power source. More particularly, the present invention relates to an internal voltage generation circuit which is provided in a semiconductor memory device and generates an internal voltage, in an amplification circuit having a feedback circuit, from a reference (constant) potential.

Recently, semiconductor devices or, more particularly, semiconductor memory devices have shown a tendency to become more dense and, as a result, the breakdown voltage of a transistor in such a device has fallen and, at the same time, the internal operation voltage has also been reduced in order to speed-up the operation and to reduce power consumption. Therefore it is necessary to reduce the voltage of a supplied power source and to generate an internal voltage, and a circuit that generates such an internal voltage is called an internal voltage generation circuit. In order to realize stable operation in such a circuit, it is necessary to generate a precise internal voltage, but because of variations in quality of products it is difficult to generate an internal voltage of required level without adjustment, therefore, a correction circuit is provided for each device for a precise adjustment of an internal voltage.

FIG. 1 illustrates the configuration of a general internal power source generation circuit.

As shown in FIG. 1, an internal power source generation circuit generates a predetermined potential level FVL in a temperature-compensated level generation circuit (a reference potential level generation circuit) 12 and inputs FVL to an inverting input terminal of an amplifier 14. The output of the amplifier 14 is a reference voltage and is input to the gate of a P channel transistor 15, and an internal voltage is output from the drain (node B) of the P channel transistor 15. The output internal voltage is equal to the output of the amplifier 14 minus the voltage between the gate and the drain of the P channel transistor 15.

The temperature-compensated level generation circuit 12, which is widely known and thus a detailed description is omitted here, outputs a constant potential FVL irrespective of temperature by utilizing the fact that the resistance increases as the temperature increases but, on the contrary, the voltage between the gate and the source of a transistor decreases. The temperature-compensated level generation circuit 12, however, has two convergent points, that is, the middle level and the ground level, therefore when the power of the device is turned on, a P channel transistor 13 is temporarily turned on, the output of the temperature-compensated level generation circuit 12 is connected to the high potential side of the power source, and after the conversion toward the middle level starts the P channel transistor 13 is turned off. Reference number 11 is an initiation signal generation circuit that generates a signal to be applied to the gate of the P channel transistor 13. This circuit is also widely known, so a detailed description is omitted here. Because the initiation signal is used in other parts of the device, the initiation signal generated by the initiation signal generation circuit 11 is supplied to parts other than the internal voltage generation circuit.

A plurality of resistors 18-1 through 18-15 and 19 is connected in series between the output of the internal voltage generation circuit and the ground. Further, the non-inverting input terminal (node A) of the amplifier 14 is connected to the output of the internal voltage generation circuit and each connection node between each resistor via transfer gates 20-1 through 20-16. A 4-bit selection signal can be set by cutting or not cutting each of the fuses F1 through F4 of a selection circuit 16, and a state can be selected from among 16 states. A decoder 17 decodes a 4-bit selection signal and turns one of 16 outputs to H. This output is applied to the transfer gates 20-1 through 20-16 directly or via inverters 21-1 through 21-16 and turns on one of the transfer gates 20-1 through 20-16.

If we assume that the resistors 18-1 through 18-16 have the same resistance of r and a resistor 19 has a resistance of R, the voltage of the non-inverting input terminal of the amplifier 14 is VA, and the internal voltage is VB, then $VA/VB=(R+(16-n)r)/(R+15r)$, when the n (1-16) th transfer gate is brought into conduction. For example, when the first transfer gate is brought into conduction, $VA/VB=1$ and when the sixteenth transfer gate is brought into conduction, $VA/VB=R/(R+15r)$. This makes it possible to feed back the internal voltage to the non-inverting input terminal, which is the reference of amplification (or reduction) of the amplifier 14, and to adjust the internal voltage to a desired value because the ratio between the voltage VA of the non-inverting input terminal and the internal voltage can be set to one of 16 values.

In this case, an adjustable range is determined with the range of variations in devices being taken into consideration, and the adjustment width of a step is determined based on the required precision. Therefore, it is necessary to narrow the adjustment width of a step in order to increase the precision of the output voltage. In the sample in FIG. 1, the selection signal is 4-bit, that is, 16 settings are available, and the decoder 17 that selects one from 16 signal lines, which are distinguished from each other by the four fuses F1 through F4 (4-bit), and 16 sets of an inverter, a transfer gate, and a resistor are provided. In the internal voltage generation circuit in FIG. 1, as mentioned above, if the adjustment width is narrowed, that is, the number of correction points is increased, the size of the decoder 17 is enlarged accordingly, and the number of sets of inverter, transfer gate, and resistor is increased, for the same size of the adjustable range. Therefore a problem that the circuit area is increased appears if the number of correction points is increased.

Further, in the internal voltage generation circuit in FIG. 1, an initiation signal is applied to the gate of the P channel transistor 13, which is connected between the output of the temperature-compensated level generation circuit 12 and the power source. Since the initiation signal generation circuit 11 detects the change in external power source and generates an initiation signal, in some cases the initiation signal is not generated even when the output of the temperature-compensated level generation circuit 12 temporarily drops due to such as an overload and begins to converge toward the ground level. In this case, a problem in that a desired internal voltage is not generated because the output of the temperature-compensated level generation circuit 12 converges toward the ground level occurs. This prevents the device from functioning properly because no internal voltage is generated.

SUMMARY OF THE INVENTION

The present invention solves these problems and the purpose of the present invention is to realize an internal voltage generation circuit, with a small area, that has many correction points and provides an output voltage with a high precision, and an internal voltage generation circuit that generates an internal voltage again without fail even if the output of the temperature-compensated level generation circuit is temporarily drops.

In order to realize the above-mentioned purpose, the internal voltage generation circuit of the present invention uses a feedback circuit in which resistors are connected in series and at least one of which has different value of resistance, and provides transfer gates in parallel with the resistors with different values of resistance. Since this configuration has a decoding function, a decoder can be omitted and the number of sets of an inverter, a transfer gate, and a resistor can be decreased, therefore the area of the circuit can be reduced without decreasing the number of correction points.

Furthermore, the internal voltage generation circuit of the present invention detects the change in output of the temperature-compensated level generation circuit (reference potential level generation circuit) and brings the switch circuit between the output and the power source into conduction when the output is less than a predetermined value, and provides the reference potential level detection circuit to generate a detection signal that brings the switch circuit out of conduction and uses the detection signal instead of the initiation signal when the output is more than a predetermined value. This ensures that the internal voltage is generated again without fail even if the output of the reference potential level generation circuit temporarily drops.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 2:
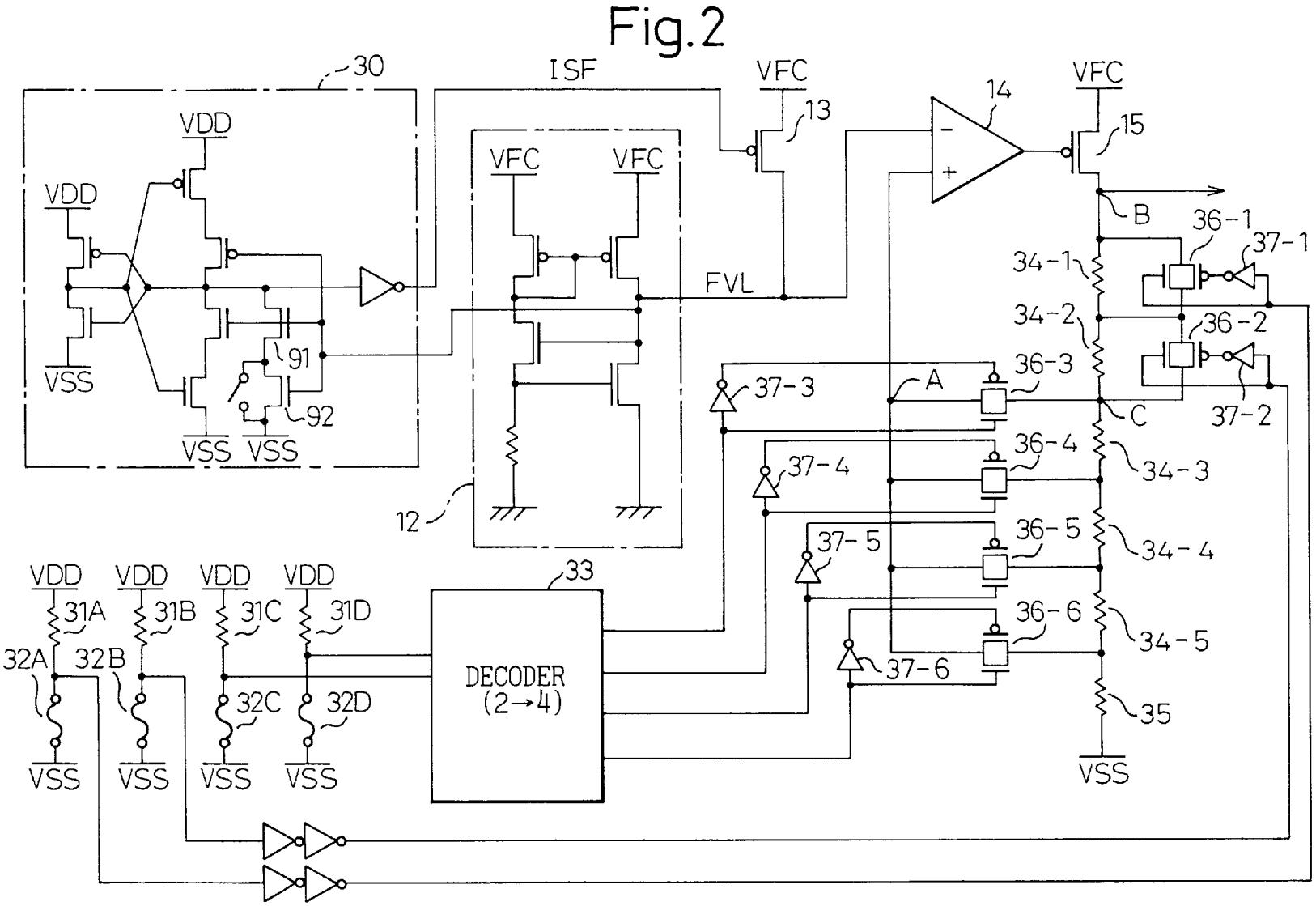
FIG. 2 illustrates the configuration of the internal voltage generation circuit in the first embodiment of the present invention.

FIG. 2 illustrates the configuration of the internal voltage generation circuit in the first embodiment of the present invention.

The internal voltage generation circuit of the present invention differs from a general internal voltage generation circuit in that a reference potential level detection circuit 30 is provided instead of the initiation signal generation circuit 11 and the configuration of the feed back circuit is different. The feedback circuit is described first.

As shown schematically, resistors 34-1 through 34-5 and 35 are connected in series between the output node B of this circuit and the ground. The resistances of the resistors 34-1 and 34-2 are different and, for example, the resistor 34-1 has a resistance of r and the resistor 34-2 has a resistance of 2r. More concretely, the resistor 34-1 has a resistance of 25 kΩ and the resistor 34-2 has a resistance of 50 kΩ. On the other hand, the resistors 34-3 and 34-4 have the same resistance and are, for example, 200 kΩ. Further, the resistor 35 has a resistance of 1.4 MΩ. These resistances are determined based on the adjustable range or the adjustment width of a step.

Transfer gates 36-1 and 36-2 are provided in parallel to the resistors 34-1 and 34-2. The connection node between a resistor 31A and a fuse 32A, which are connected in series in the power source, is connected to one of the gates of the transfer gate 36-1 via two inverters, and further connected to the other gate of the transfer gate 36-1 via another inverter. Therefore, the transfer gate 36-1 is off (out of conduction state) when the fuse 32A is not cut, or on (conduction state) when the fuse 32A is cut. Similarly, the transfer gate 36-2 is off when a fuse 32B is not cut, or on when the fuse 32B is cut.

The non-inverting input terminal (node A) of the amplifier 14 is connected to the connection nodes between the resistors 34-2 and 34-3, the resistors 34-3 and 34-4, the resistors 34-4 and 34-5, and the resistors 34-5 and 35, respectively, via transfer gates 36-3 through 36-6. The connection node between a resistor 31C and a fuse 32C, which are connected in series in the power source, and the connection node between a resistor 31D and a fuse 32D, which are connected in series in the power source are connected to a decoder 33. Depending upon whether or not the fuse 32C or the fuse 32D is cut, a two-bit selection signal can be set and the decoder 33 decodes the selection signal and turns one of four outputs to H. The four outputs are connected to one side of each of the transfer gates 36-3 through 36-6, respectively and at the same time connected to the other side of each of the transfer gates 36-3 through 36-6 via inverters 37-3 through 37-6, respectively. Therefore, one of the transfer gates 36-3 through 36-6 turns on and others turn off. For example, when the fuse 32C or 32D is not cut the transfer gate 36-3 turns on, when the fuse 32C is cut and the fuse 32D is not cut the transfer gate 36-4 turns on, when the fuse 32C is not cut and the fuse 32D is cut the transfer gate 36-5 turns on, and when both the fuses 32C and 32D are cut the transfer gate 36-6 turns on.

Since the resistance r1 of the resistor 34-1 and the resistance r2 of the resistor 34-2 are different, the resistance between the node B and the connection node C between the resistors 34-2 and 34-3 is zero, r1, r2, or r1+r2 according to the states of the transfer gates 36-1 and 36-2. Further, there can be four states depending upon which is turned on among the transfer gates 36-3 through 36-6, therefore, 16 correction points can be obtained in total.

Figure 1:
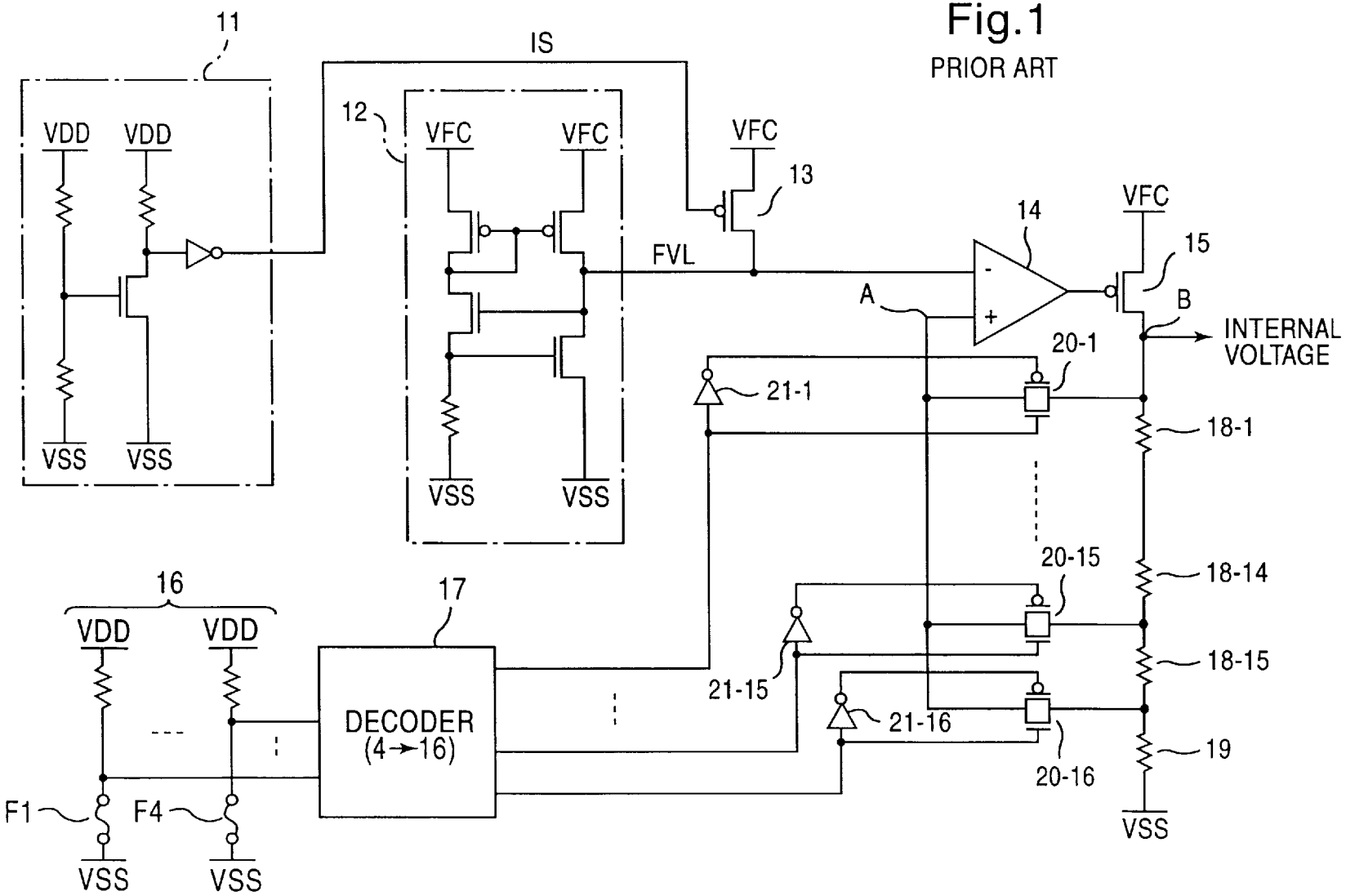
Fig.1 PRIOR ART
FIG. 1 illustrates the configuration of a general internal voltage generation circuit.

As mentioned above, 16 correction points can be obtained in the first embodiment similarly as in FIG. 1, but since the number of sets of resistor, transfer gate, and inverter is reduced from 16 to 6, and the decoder that decodes a 4-bit signal is replaced with the decoder that decodes a 2-bit signal, the circuit area can be reduced.

It is also possible to use an N channel transistor or a P channel transistor instead of a transfer gate, or other switch devices.

Next the reference potential level detection circuit 30 is described. This circuit has a latch circuit (flip flop) in which two inverters are connected. The output node of one of the two inverters is used as a drain, the ground as a source, and N channel transistors 91 and 92, to which the output FVL of the temperature-compensated level generation circuit (reference potential level generation circuit) is applied, are connected tothe gate. Since the N channel transistors turn off and the output of the circuit turns to H when the output FVL is low, the reference potential level detection signal ISF turns to L, the P channel transistor 13 turns on, and the output FVL is connected to the high potential side of the power source. When the output FVL is raised in this state and begins to converge toward the middle level, the N channel transistors 91 and 92 turn on, the state of the latch circuit is reversed to turn the output ISF to H, and the P channel transistor 13 turns off.

Here, a switch is provided in parallel to the N channel transistor 92 and the number of N channel transistors that are connected in series between the output node and the ground by bringing the switch into conduction or out of conduction. This makes it possible to adjust the output FVL level that reverses the state of the latch circuit, that is, the output FVL level that changes the state of the P channel transistor 13 from on to off. The number of the N channel transistors to be connected in series can be three or more.

As mentioned above, since the state of the P channel transistor 13 is controlled according to the output FVL level of the temperature-compensated level generation circuit (reference potential level generation circuit) in the reference potential level detection circuit 30 in the first embodiment, the P channel transistor 13 turns on to make the output FVL a high potential when the output FVL drops, and the temperature-compensated level generation circuit 12 is made to converge toward the middle level without fail. Therefore the generation of the internal voltage is ensured.

In some semiconductor devices a special mode is provided, in which the internal voltage generation circuit is terminated though the external power source is provided. In this case, since the internal voltage generation circuit is terminated, VFC becomes the GND level and FVL also becomes the GND level gradually and remains stable. When the state of the internal voltage generation is restored from this state, VFC is raised quickly but it takes some time for FVL to rise. To solve this problem, ISF is put into the "L" state in advance to turn on the P channel transistor 13 when the internal voltage generation circuit is terminated so that FVL is raised simultaneously when VFC is raised and the state is smoothly restored from the internal voltage generation circuit terminated state. Therefore, when there is such a special mode, the N channel transistor 93 is connected in series between the source of the N channel transistor 92 and the ground, and the internal voltage generation termination signal ("H" when the internal voltage generation is terminated) is applied to the gate.

Figure 4:
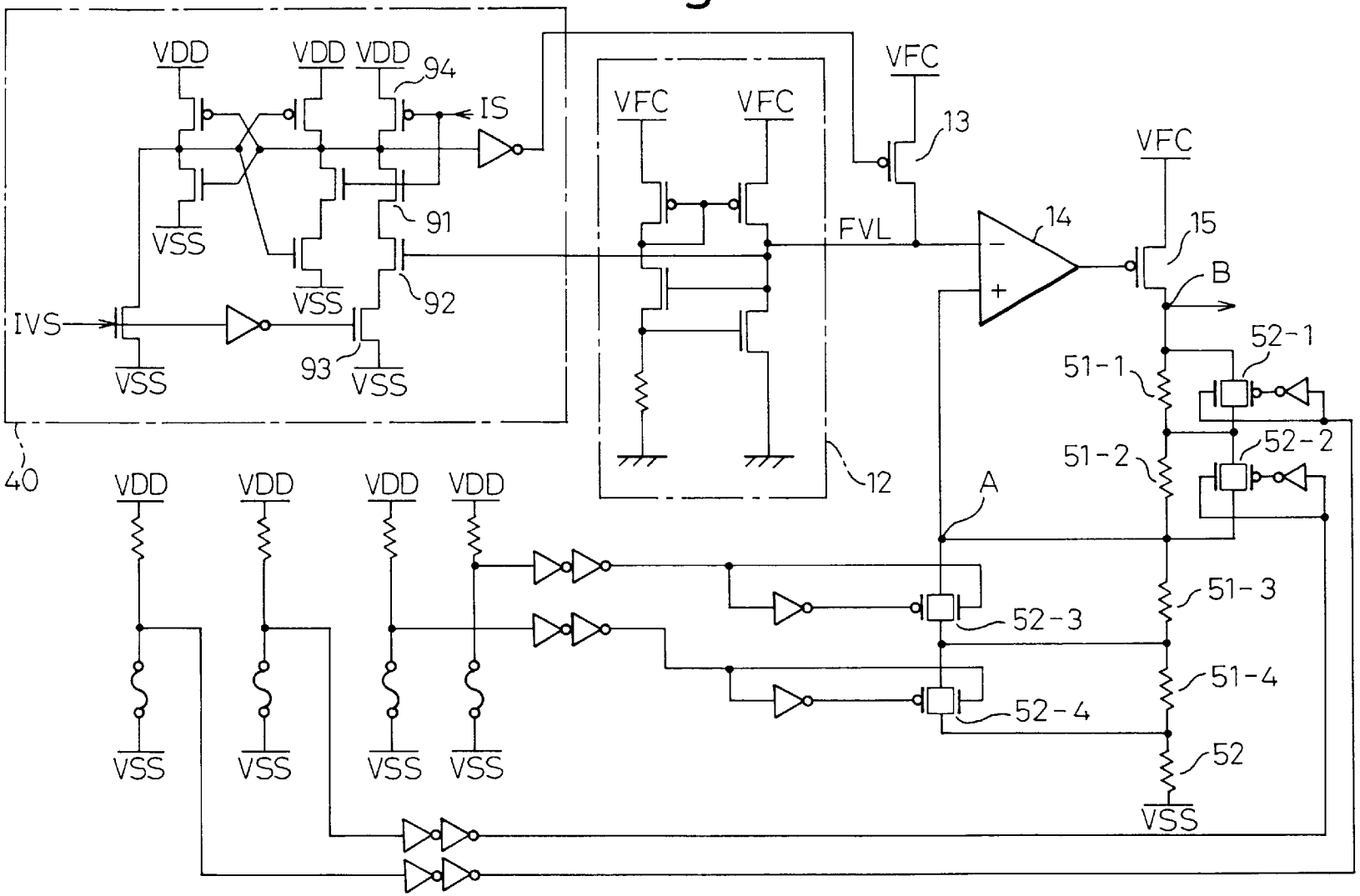
FIG. 4 illustrates the configuration of the internal voltage generation circuit in the second embodiment of the present invention.

FIG. 4 illustrates the configuration of the internal voltage generation circuit in the second embodiment of the present invention. The difference between the circuits in the first and second embodiments is a reference potential level detection circuit 40 and the feed back circuit.

Figure 3:
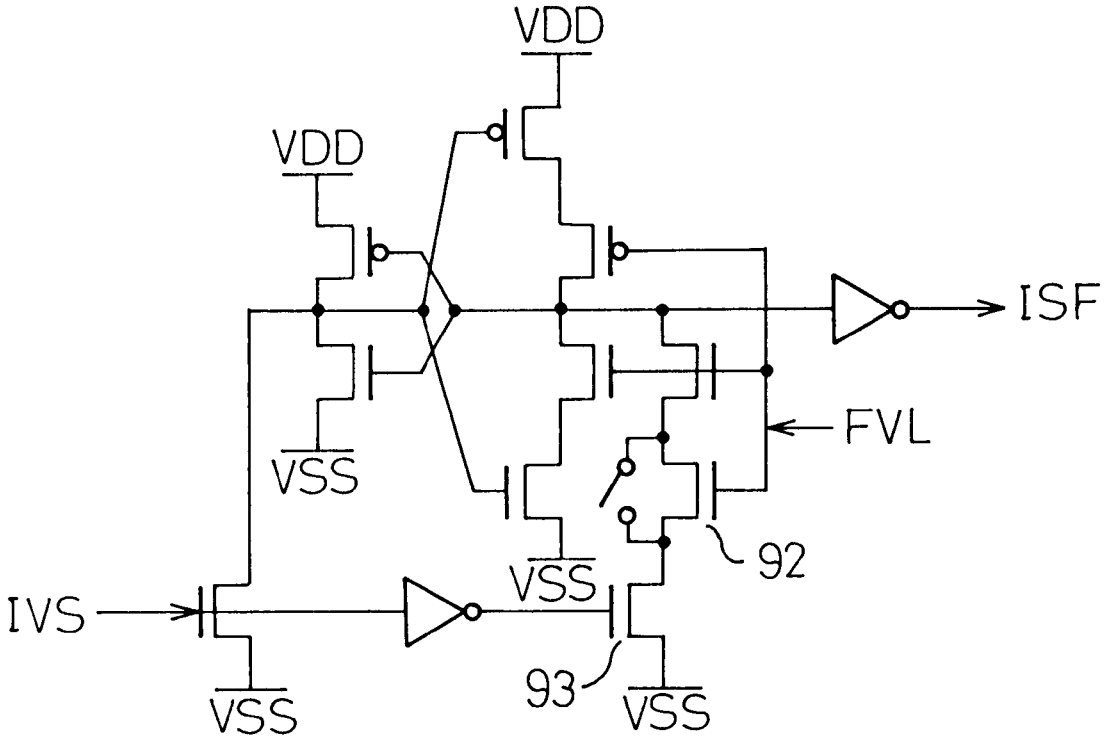
FIG. 3 illustrates an example of modification of the reference potential level detection circuit.

The reference potential level detection circuit 30 in the first embodiment and the circuit in FIG. 3 are the circuit that does not need the initiation signal, but it is preferable if the internal voltage generation circuit can be operated by the initiation signal when installed in a chip in which there originally exists the initiation signal. In the reference potential level detection circuit 40, the initiation signal IS is applied to the gate of the N channel transistor 91 and at the same time a P channel transistor 94 is provided between the high potential side of the external power source and the output node (drain of the N channel transistor 91) of the reference potential level detection circuit 40 and the initiation signal IS is applied to the gate as shown in FIG. 4. This makes it possible to turn on the P channel transistor 13 using the initiation signal.

In the feedback circuit, five resistors 51-1 through 51-4 and 52 of different resistances are connected in series and transfer gates 52-1 through 52-4 are provided in parallel to the resistors 51-1 through 51-4. This further reduces the number of sets of a resistor, a transfer gate, and an inverter compared to that in the first embodiment and the decoder can be eliminated. In this case, however, since the node A is connected directly to the connection node between the resistors 51-2 and 51-3, the number of correction points may be reduced accordingly.

Figure 5:
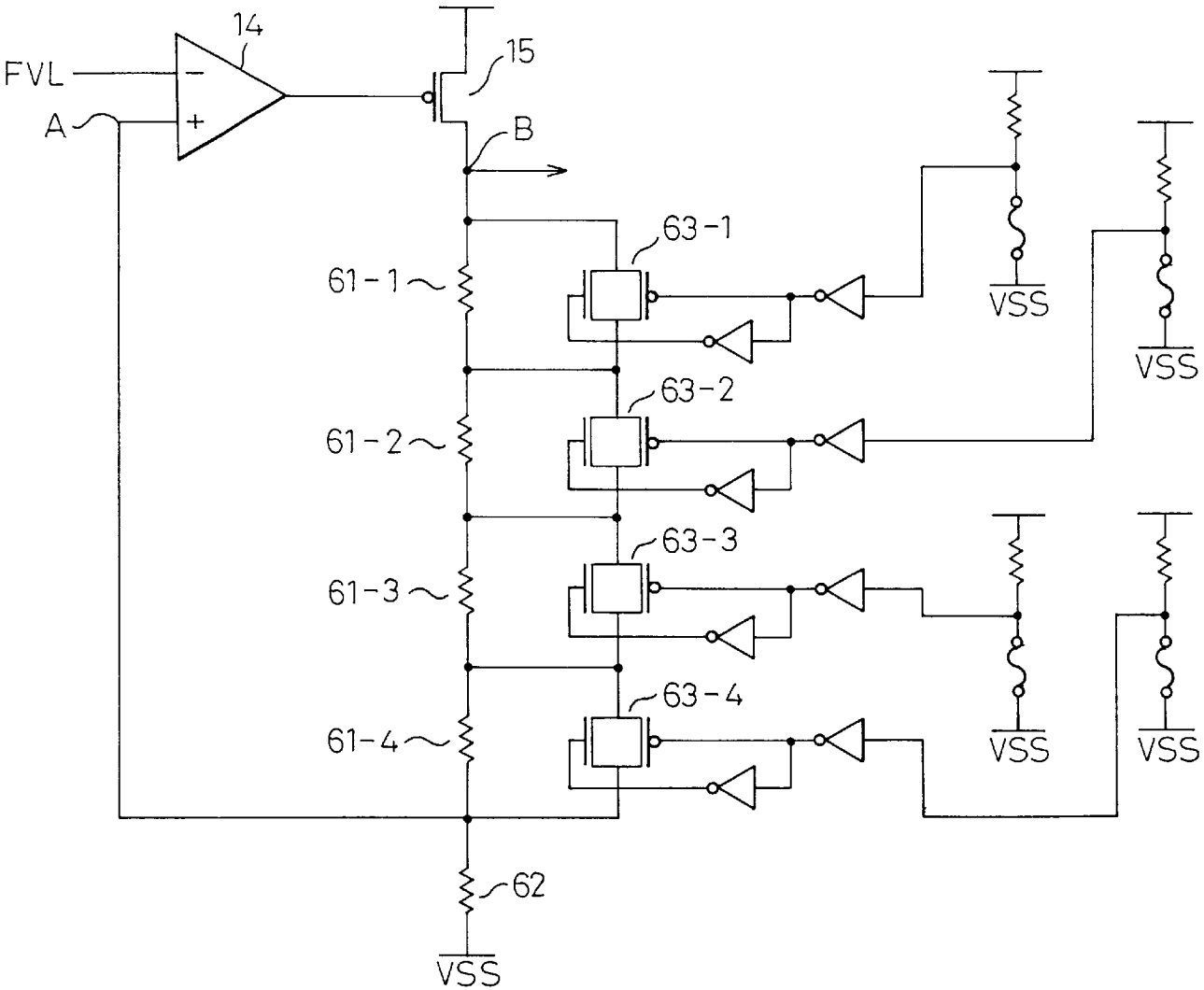
FIG. 5 illustrates an example of modification of the feedback circuit.

Further it is possible to use a feedback circuit as shown in FIG. 5. In this case, resistors 61-1 through 61-4 and 62 of different resistances are connected in series between the node B and the ground and transfer gates 63-1 through 63-4 are provided in parallel to the resistors 61-1 through 61-4. The node A is connected to the connection node between the resistors 61-4 and 62. In this case, the number of sets of resistor, transfer gate, and inverter is the same as that in the second embodiment and the decoder is eliminated. The number of correction points is 16. Therefore, the circuit area can be significantly reduced while the number of correction points is maintained.

As mentioned so far, according to the present invention, an internal voltage generation circuit with a small circuit area, which has many correction points and can provide an output voltage with a high precision, can be realized and at the same time an internal voltage generation circuit that generates the internal voltage again without fail when the output of the temperature-compensated level generation circuit (reference potential generation circuit) temporarily drops can also be realized.

What is claimed is:

1. A reference potential supply circuit, comprising:

a reference potential generation circuit for generating a reference potential at a reference potential output node;

a reference potential level detection circuit for detecting a level of the reference potential and outputting a detection signal; and a charge transistor for selectively applying the reference potential output node with a power source in response to the detection signal;

wherein the reference potential level detection circuit comprises:

a flip-flop circuit having an input/output node coupled to the charge transistor; and a detection transistor receiving the reference potential for controlling a level at the input/output node of the flip-flop circuit.

2. The reference potential supply circuit as set fourth in claim 1, the flip-flop circuit comprising:

first and second inverter circuits, each including a PMOS transistor and a NMOS transistor connected in series between power source lines, an output of one of the inverter circuits being connected to the other of the inverter circuits; and a pair of switches, one of which is connected in series with the PMOS transistor between one of the power source lines and the input/output node of the flip-flop, the other of which being connected in series with the NMOS transistor between the input/output node and the other of the power source lines, and one of the pair of switches turning on in response to the level of the reference potential.

3. An internal voltage generation circuit, comprising:

a reference potential generation circuit for generating a reference potential at a reference potential output node;

a reference potential level detection circuit for detecting a level of the reference potential and outputting a detection signal;

a charge transistor for selectively applying the reference potential output node with a power source in response to the detection signal;

an amplifier having first and second input terminals, the first input terminal receiving the reference potential, the amplifier for outputting a control signal according to a voltage between the first and second input terminals;

a transistor connected between the power source and an internal power supply line, a conductance of the transistor being controlled by the control signal; and a feedback path coupled between the internal power supply line and the second input terminal of the amplifier, the feedback path including a resistor and a switch, and the switch connected in parallel with the resistor;

wherein the reference potential level detection circuit includes:

a flip-flop circuit having an input/output node coupled to the charge transistor;

a detection transistor receiving the reference potential for controlling a level at the input/output node of the flip-flop circuit; and a reset circuit for resetting the flip-flop circuit and inactivating the detection transistor when the internal voltage generation circuit does not operate.

* * * * *